US006855235B2

(12) United States Patent
Herchen et al.

(10) Patent No.: US 6,855,235 B2
(45) Date of Patent: Feb. 15, 2005

(54) ANODE IMPEDANCE CONTROL THROUGH ELECTROLYTE FLOW CONTROL

(75) Inventors: Harald Herchen, Los Altos, CA (US); Craig Brodeur, Marlborough, MA (US); Quinwei Wu, Westford, MA (US); Peter Kimball, Dennis, MA (US); Vincent Burkhart, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 362 days.

(21) Appl. No.: 10/156,749

(22) Filed: May 28, 2002

(65) Prior Publication Data

US 2003/0221957 A1 Dec. 4, 2003

(51) Int. Cl.[7] ..... C25B 9/00

(52) U.S. Cl. ..... 204/297.06; 204/297.01; 204/297.08; 204/199; 204/212; 204/213; 204/224 R; 204/232; 204/237; 204/275.1; 204/286.1; 204/287; 205/292

(58) Field of Search ..... 204/297.01, 297.06, 204/297.08, 286.1, 287, 199, 212, 213, 224 R, 232, 237, 275.1; 205/292

(56) References Cited

U.S. PATENT DOCUMENTS

| | | | | |
|---|---|---|---|---|
| 4,698,546 A | | 10/1987 | Maitland et al. | 313/446 |
| 6,126,798 A | | 10/2000 | Reid et al. | 204/282 |
| 6,139,384 A | | 10/2000 | DeTemple et al. | 445/24 |
| 6,217,725 B1 | | 4/2001 | Van Anglen et al. | 204/207 |
| 6,261,433 B1 | * | 7/2001 | Landau | 205/96 |
| 6,416,647 B1 | * | 7/2002 | Dordi et al. | 205/137 |
| 6,521,102 B1 | * | 2/2003 | Dordi | 204/252 |
| 6,576,110 B2 | * | 6/2003 | Maydan | 205/89 |
| 6,613,214 B2 | * | 9/2003 | Dordi et al. | 205/118 |
| 2001/0040099 A1 | | 11/2001 | Pedersen et al. | |

FOREIGN PATENT DOCUMENTS

| | | | |
|---|---|---|---|
| JP | 05-306493 | 11/1993 | C25D/7/00 |
| RU | 2036258 | 5/1995 | C25F/7/00 |
| WO | WO01/63018 | 8/2001 | C25D/17/00 |

* cited by examiner

*Primary Examiner*—Bruce F. Bell
(74) *Attorney, Agent, or Firm*—Moser, Patterson & Sheridan

(57) ABSTRACT

Embodiments of the invention generally provide an electrochemical plating cell having an electrolyte container assembly configured to hold a plating solution therein, a head assembly positioned above the electrolyte container, the head assembly being configured to support a substrate during an electrochemical plating process, and an anode assembly positioned in a lower portion of the electrolyte container. The anode assembly generally includes a copper member having a substantially planar upper surface, at least one groove formed into the substantially planar upper surface, each of the at least one grooves originating in a central portion of the substantially planar anode surface and terminating at a position proximate a perimeter of the substantially planar upper surface, and at least one fluid outlet positioned at a perimeter of the substantially planar upper anode surface.

36 Claims, 6 Drawing Sheets

ANODE IMPEDANCE CONTROL THROUGH ELECTROLYTE FLOW CONTROL

BACKGROUND OF THE INVENTION

1. Field of the Invention

Embodiments of the invention generally relate to electrochemical plating systems, and in particular, anodes for electrochemical plating systems.

2. Description of the Related Art

Metallization of sub-quarter micron sized features is a foundational technology for present and future generations of integrated circuit manufacturing processes. More particularly, in devices such as ultra large scale integration-type devices, i.e., devices having integrated circuits with more than a million logic gates, the multilevel interconnects that lie at the heart of these devices are generally formed by filling high aspect ratio (greater than about 4:1, for example) interconnect features with a conductive material, such as copper or aluminum, for example. Conventionally, deposition techniques such as chemical vapor deposition (CVD) and physical vapor deposition (PVD) have been used to fill these interconnect features. However, as the interconnect sizes decrease and aspect ratios increase, void-free interconnect feature fill via conventional metallization techniques becomes increasingly difficult. As a result thereof, plating techniques, such as electrochemical plating (ECP) and electroless plating, for example, have emerged as viable processes for void free filling of sub-quarter micron sized high aspect ratio interconnect features in integrated circuit manufacturing processes.

In an ECP process, for example, sub-quarter micron sized high aspect ratio features formed into the surface of a substrate may be efficiently filled with a conductive material, such as copper, for example. ECP plating processes are generally two stage processes, wherein a seed layer is first formed over the surface features of the substrate, and then the surface features of the substrate are exposed to an electrolyte solution, while an electrical bias is simultaneously applied between the substrate and a copper anode positioned within the electrolyte solution. The electrolyte solution is generally rich in ions to be plated onto the surface of the substrate, and therefore, the application of the electrical bias causes these ions to be urged out of the electrolyte solution and to be plated onto the seed layer.

An ECP plating solution generally contains several constituents, such as, for example, a copper ion source, which may be copper sulfate, an acid, which may be sulfuric or phosphoric acid and/or derivatives thereof, a halide ion source, such as chlorine, and one or more additives configured to control various plating parameters. Additionally, the plating solution may include other copper salts, such as copper fluoborate, copper gluconate, copper sulfamate, copper sulfonate, copper pyrophosphate, copper chloride, or copper cyanide, for example. The solution additives, which may be, for example, levelers, inhibitors, suppressors, brighteners, accelerators, or other additives known in the art, are typically organic materials that adsorb onto the surface of the substrate being plated. Useful suppressors typically include polyethers, such as polyethylene glycol, or other polymers, such as polyethylene-polypropylene oxides, which adsorb on the substrate surface, slowing down copper deposition in the adsorbed areas. Useful accelerators, which are often not organic in nature, typically include sulfides or disulfides, such as bis(3-sulfopropyl) disulfide, which compete with suppressors for adsorption sites, accelerating copper deposition in adsorbed areas. Useful levelers typically include thiadiazole, imidazole, and other nitrogen containing organics. Useful inhibitors typically include sodium benzoate and sodium sulfite, which inhibit the rate of copper deposition on the substrate.

One challenge associated with ECP systems is that several of the components/constituents generally used in plating solutions are known to react with the surface of the copper anode forming what is generally known as anode sludge. Additionally, copper anodes in ECP systems are prone to upper surface dishing, i.e., the central portion of an annular anode generally erodes faster than the perimeter, and therefore, the anode sludge accumulates in the dished out portion of the anode. Although electrolyte flow over the surface of the anode has conventionally been used to flush sludge from the surface of the anode, conventional apparatuses and flow rates have not been effective in transporting the anode sludge away from the anode surface. The accumulation of anode sludge is known to inhibit copper dissolution from the anode into the plating solution, and therefore, may affect the copper ion concentration in the plating solution, and as a result thereof, detrimentally affect the plating characteristics.

Therefore, there is a need for an apparatus and method for electrochemically plating copper, wherein the apparatus and method includes an anode configured to remove anode sludge therefrom during plating operations.

SUMMARY OF THE INVENTION

Embodiments of the invention generally provide an electrochemical plating cell having an electrolyte container assembly configured to hold a plating solution therein, a head assembly positioned above the electrolyte container, the head assembly being configured to support a substrate during an electrochemical plating process, and an anode assembly positioned in a lower portion of the electrolyte container. The anode assembly generally includes a copper member having an upper surface, at least one groove formed into the substantially planar upper surface, each of the at least one grooves originating in a central portion of the substantially planar anode surface and terminating at a position proximate a perimeter of the substantially planar upper surface, and at least one fluid outlet positioned at a perimeter of the substantially planar upper anode surface.

Embodiments of the invention further provide an anode for an electrochemical plating cell. The anode generally includes a disk shaped anode having a substantially planar upper anode surface formed thereon, the substantially planar upper surface having at least one channel and at least one fluid outlet formed therein. Additionally, each of the at least one channels originates at a central portion of the substantially planar upper surface and terminates proximate one of the at least one fluid outlets.

Embodiments of the invention further provide a copper anode for an electrochemical plating cell. The copper anode generally includes a substantially circular base member, a circular sleeve member positioned above and in sealable contact with a perimeter of the base member, and a circular disk shaped pure copper anode positioned within the sleeve member and in contact with the base member, the anode having an exposed substantially planar upper anode surface. The anode may include at least one fluid drain positioned proximate a perimeter of the anode, the at least one fluid drain being configured to communicate fluids through an interior portion of the anode, and further, the anode may include at least one fluid channel formed into the upper anode surface, each of the at least one fluid channels originating proximate a central portion of the upper anode surface and terminating proximate the at least one fluid drain, the at least one fluid channel forming a downhill fluid path from the central portion to the at least one fluid drain.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention generally provides an anode for an electroplating cell of the invention, wherein the anode is configured to provide improved flow of an electrolyte solution over the anode surface. Additionally, the anode of the invention includes channels formed into the surface of the anode extending radially outward from a central portion of the anode toward the outer perimeter of the anode. The channels are configured to receive and transport anode sludge, i.e., copper material from the anode that has not completely dissolved into the plating solution, from the central portion of the anode to the outer perimeter of the anode for removal therefrom, and as such, the present invention generally provides a sludge free anode surface.

Figure 1:
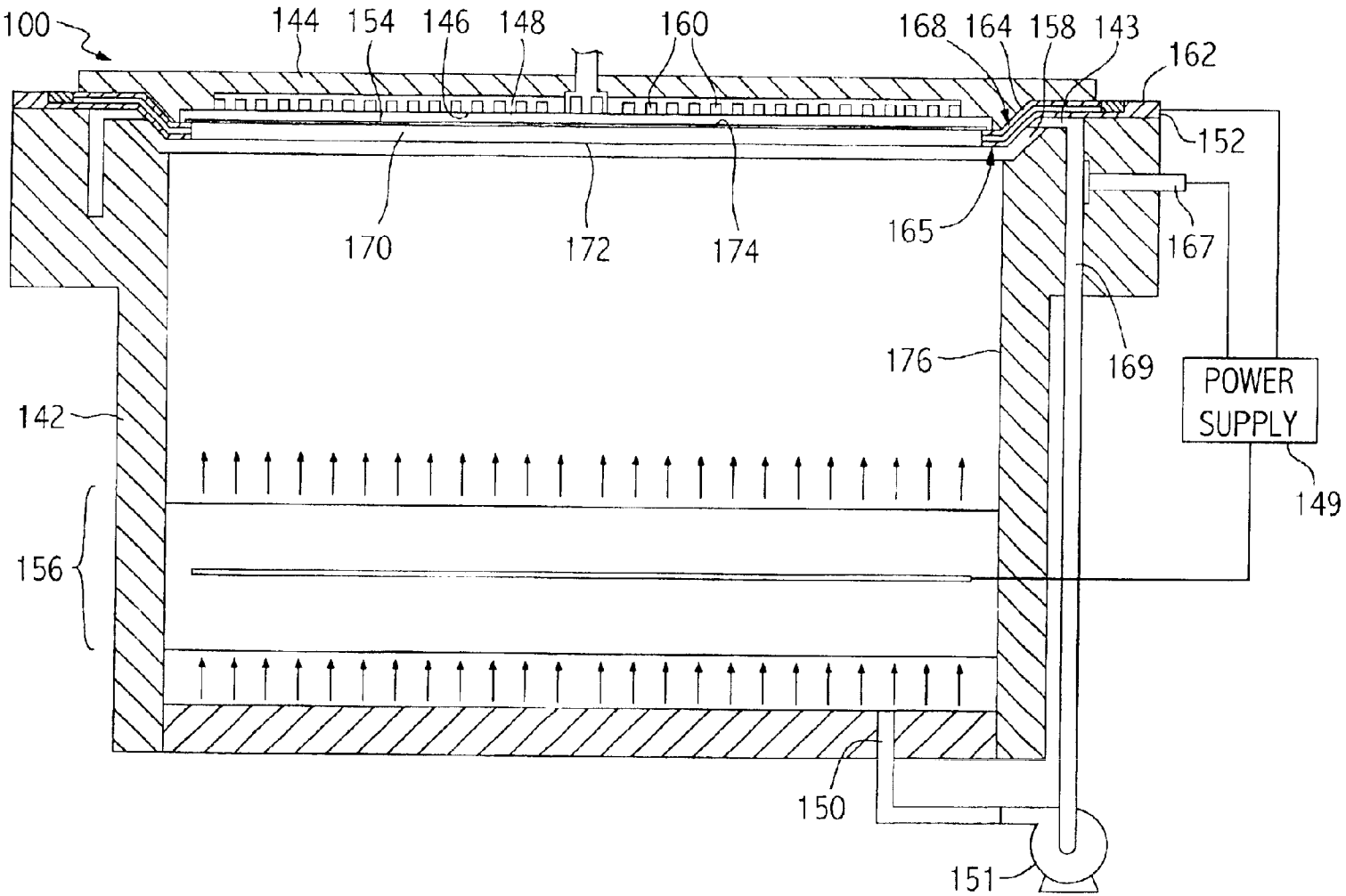
FIG. 1 illustrates a sectional view of a plating cell of the invention.

FIG. 1 illustrates a sectional view of an exemplary electroplating cell 100 of the invention. The electroplating cell 100 generally includes a container body 142 having an opening on a top portion thereof. The opening on the top portion of the container body 142 is configured to receive a lid member 144 therein, thus forming an enclosed processing region. The container body 142 is preferably made of an electrically insulative material, such as a plastic, Teflon, ceramics, or other materials known in the semiconductor art, and in particular, materials known in the electroplating art to be non-reactive with electroplating solutions. The lid 144 generally includes a substrate supporting surface 146 disposed on a lower surface thereof, ie., the lower surface of the lid 144 that is facing the opening in the container body 142. A substrate 148 is shown in parallel abutment to the substrate supporting surface 146, and may be secured in this orientation via conventional substrate chucking methods, such as vacuum chucking, for example, during plating operations. An electroplating solution inlet 150 is generally disposed near the bottom portion of the container body 142. The solution inlet 150 may be used to pump an electroplating solution into the container body 142 via a suitable pump 151. The solution may flow upwardly inside the container body 142 toward the substrate 148 to contact the exposed deposition surface 154. A consumable anode 156, which will be further discussed herein, is disposed in a lower portion of the container body 142 and is configured to slowly dissolve at a calculated rate into the electroplating solution in order to provide metal ions, i.e., copper ions, to the plating solution. The anode 156, which generally has the same perimeter shape as the interior wall of the container body 146, i.e., circular, for example, generally does not extend across the entire width of the container body 142. Therefore, the plating solution pumped into the container body 142 via inlet 150 may flow around the perimeter of anode 156 upward towards the substrate 148, i.e., between the outer surface of the anode 156 and the interior wall of the container body 142. An egress gap 158 bound at an upper limit by a shoulder 164 of a cathode contact ring 152 is generally provided near the upper portion of container body 142. The gap 158 generally leads to an annular weir 143 that is substantially coplanar with (or slightly above) a substrate seating surface 168 on the contact ring 152, and therefore, slightly above the deposition surface 154 of the substrate 148. The weir 143 is positioned to ensure that the deposition surface 154 is in contact with the electroplating solution when the electroplating solution is flowing out of the egress gap 158 and over the weir 143 while a substrate is in a processing position, i.e., when a substrate is secured to the lower surface of lid member 144 while lid member 144 is in a closed/processing position.

Figure 2:
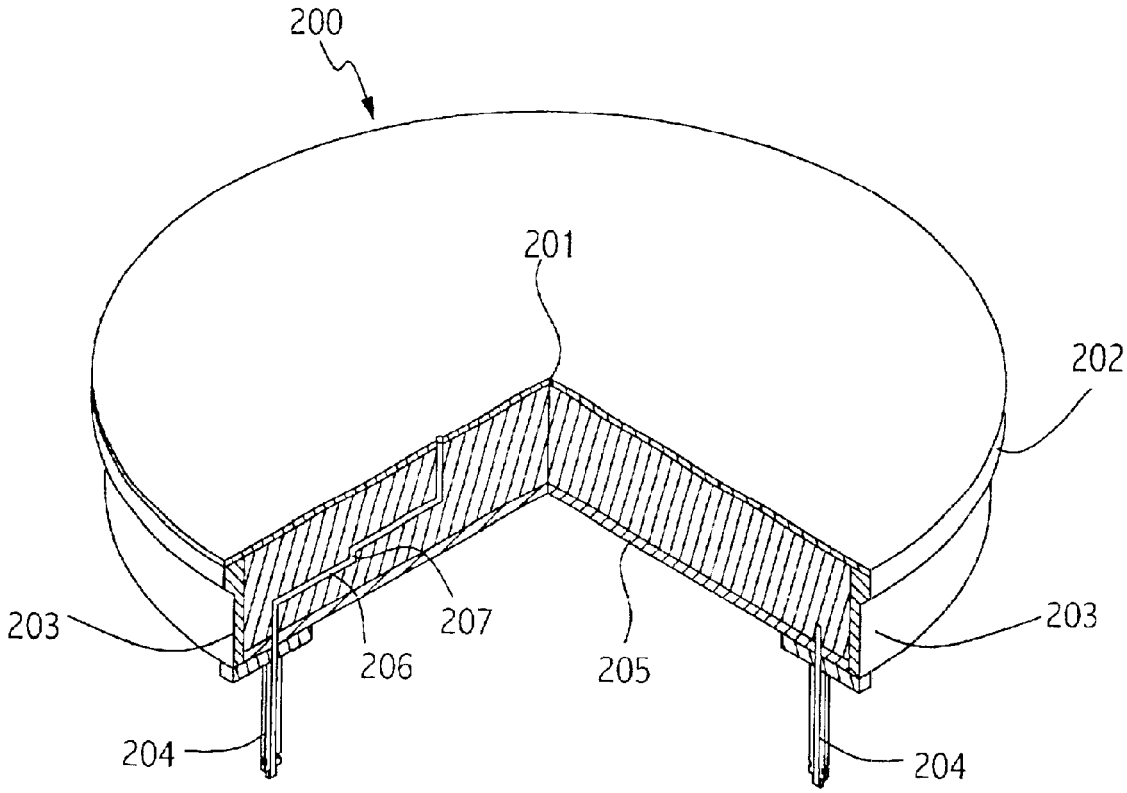
FIG. 2 illustrates a partial sectional view of an anode of the invention.

FIG. 2 illustrates a partial sectional view of an exemplary anode of the invention. The exemplary anode 200 illustrated in FIG. 2 is intended to illustrate the features of anode 156 shown in FIG. 1. Anode 200 is generally disk shaped, i.e., a three dimensional solid having a circular perimeter and two generally planar opposing surfaces, and includes an outer perimeter portion 202 and a central portion 201 on an exposed surface, which is generally planar across the exposed surface. The disk shaped anode is generally incased on the circular perimeter portion 202 by a cylindrical or sleeve shaped member 203. Sleeve member 203, therefore, generally operates to enclose the outer perimeter portion 202 of anode 200, i.e., sleeve 203 may prevent the plating solution from contacting the outer perimeter portion 202 of anode 200. Additionally, the bottom portion of the anode 200 generally rests on a base portion 205, which is generally a disk shaped member sized to cover the bottom portion of anode 200, while cooperatively operating with sleeve 203 so that the outer perimeter 202 of anode 200 is also covered/enclosed from the plating solution. The sleeve 203 and base 205 portions may, for example, be manufactured from one or more of a plurality of materials, such as, for example, Teflon, ceramics, plastics, and other insulative materials that are known to be acceptable for use in electroplating cells. The combination of the sleeve 203 and base 205 portions, which are generally termed a support ring, operates to enclose the anode 200 on the side and bottom portions, and therefore, leaves only the top or upper planar surface of the anode 200 exposed to the electrolyte or plating solution.

Anode 200 further includes one or more fluid outlets 204 positioned near the perimeter portion 202 of anode 200. The fluid outlets 204, which may be hollowed pieces of titanium, are in fluid communication with an electrolyte solution recovery system (not shown), and therefore, fluid outlets 204 are configured to receive a portion of the electrolyte solution traveling over the surface of anode 200. The receiving ends of the fluid outlets 204 are positioned in terminating ends of sludge channels 206 formed into the upper exposed surface of anode 200. Although the fluid outlets 204 are illustrated as being positioned so that they communicate fluids through the interior of anode 200, the invention is not limited to this configuration. For example, it is contemplated that the fluid outlets 204 may be positioned outside the perimeter of anode 200, through, for example, the member surrounding the anode 200. In this aspect of the invention, the fluid flowing across the surface of the anode may be drawn over the edge of the anode 200 into fluid outlets 204 positioned immediately outward the perimeter of the anode surface. Sludge channels 206 are generally trenches or channels that originate near the central portion 201 of anode 200 and extend radially outward toward the perimeter portion 202 of anode 200. The channels 206 generally increase in depth as the channels 206 extend radially outward toward the perimeter portion 202, and as such, channels 206 form a downhill path for fluids that originate near the central portion 201 and terminate near the perimeter portion 202 at the fluid outlets 204. The anode channels 206 may increase in depth linearly as the radial distance from the central portion 201 increases. Additionally, as shown in FIG. 2, the depth of channels 206 may increase stepwise, i.e., the channels may include two or more substantially level or horizontal portions 206 having interstitially positioned step down sections 207 that increase the depth of channels 206. In cross section, channels 206 may be V-shaped, semicircular, square shaped, or any other shape that facilitates fluid flow within the respective channel 206. The surface of anode 200 may include any number of fluid channels 206, however, the selection of the number of channels 206 should consider the volume of copper removed from the anode 200 to form each of the channels 206, as the quantity of copper removed will generally reduce the anode life. Embodiments of the present invention contemplate that between about 1 and about 6 fluid channels 206 may be used, and more particularly, between about 2 and about 4 fluid channels 206 may be used to optimize fluid flow while maintaining anode life.

Figure 3:
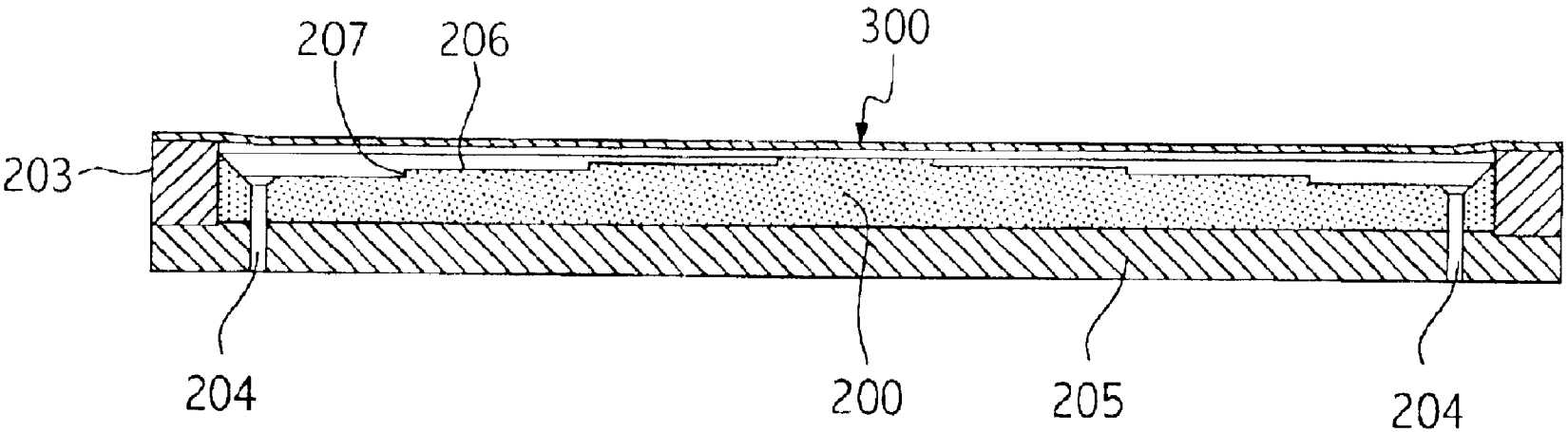
FIG. 3 illustrates a partial sectional view of another embodiment of an anode of the invention.

Additionally, as illustrated in FIG. 3, anode 200 may further include a permeable membrane 300 positioned immediately above the upper exposed surface of the anode 200. The membrane 300 may be attached to the upper surface of the support ring outer walls 203 that surround anode 200. As such, the membrane 300 may extend over the entire exposed surface of the anode 200, and therefore, essentially enclose anode 200 within the space defined by the base member 205, sidewalls 203, and the membrane 300. The membrane 300 generally includes a plurality of pores formed therein, wherein the size of the pores is configured to allow the above noted constituents of a conventional plating solution to pass therethrough. In one embodiment of the invention membrane 300 has pores sized between about 0.05 microns and about 0.5 microns. In another embodiment of the invention membrane 300 has pores sized between about 0.1 microns and about 0.3 microns. In another embodiment, membrane 300 includes pores sized between about 0.15 microns and about 0.25 microns, for example. As a result of the fluid outlets 204 evacuating a portion of electrolyte solution from the surface of the anode 200, a reduced pressure may be created in the area between the upper surface of the anode 200 and the lower surface (the side of the membrane facing the anode 200). This reduced pressure generally operates to create a slight downward flow of electrolyte solution through membrane 300. The electrolyte generally flows through membrane 300 and then flows radially outward across the surface of anode 200 before being received in fluid outlets 204. The outward radial flow of the electrolyte solution across the surface of anode 200 generally operates to wash particles residing on the surface of anode 200 radially outward toward the perimeter 202 thereof, and in particular, the channels 206 may receive these particles and assist in transporting the particles outwardly towards fluid outlets 204. More particularly, when the surface of anode 200 becomes dished, i.e., after substantial use, channels 206 operate to receive anode sludge and transport the sludge to the perimeter of the anode 200, despite the fact that the surface of the anode 200 is uphill from the center of the anode outward, as the channels 206 provide a downhill path that facilitates outward sludge flow.

Embodiments of the invention contemplate that the membrane 300 may be either loosely attached to the outer walls 203, or alternatively, stretched in a relatively taught manner over the surface of anode 200 so that there is little slack in the surface of the membrane 300. When membrane 300 is loosely positioned, for example, it may be inflated in similar fashion to a balloon if reverse flow of electrolyte were provided, i.e., if electrolyte was flowed into the region between the membrane 300 and the anode 200 by fluid outlets 204. Although inflation is not generally intended during plating operations, the inflation characteristic is mentioned to illustrate the attachment looseness of an embodiment of the membrane 300. Alternatively, if the membrane is positioned in a relatively taught manner, then reverse flow would have little effect on the shape of the membrane, as the taughtness would not allow the membrane to expand in the same manner (like a balloon) as the loosely attached membrane. Whether the membrane is loosely attached or taughtly positioned, the membrane is generally positioned to either contact the anode surface, or alternatively, be positioned immediate thereto. As such, fluids flowing through the membrane 300, which generally flow through the membrane in the direction of the anode as a result of the fluid outlets 204, are caused to flow horizontally across the surface of the anode 200. This horizontal flow assists in the removal of sludge from the anode surface. Additionally, the membrane 300 operates to isolate the sludge generated on the anode surface from the plating solution that contacts the substrate being plated, as the contaminants in the sludge are known to adversely affect plating operations.

Membrane 300 has been shown to substantially improve plating characteristics for copper electroplating systems using a pure copper anode, i.e., anodes wherein the copper concentration is above about 99.0% copper. Plating systems generally employ one of two types of anodes: first an insoluble anode, such as platinum or other heavy metals, for example; or second a soluble anode, such as copper or copper phosphate, for example. More particularly, although conventional soluble anodes are generally a copper phosphate alloy-type anodes, pure copper soluble anodes provide advantages over copper phosphate anodes. However, it has been determined that when a membrane, such as membrane 300 discussed above, comes in contact with a copper phosphate anode, the black gel layer that forms on copper phosphate anodes is degraded. Inasmuch as the black gel layers are critical to obtaining proper plating characteristics from copper phosphate anodes used without separation membranes, degradation of the black gel layers has not been an acceptable approach, and therefore, membranes positioned in contact with the copper phosphate anodes have been undesirable. However, when a pure copper anode is used, no black gel layer is formed, and therefore, the contact of the membrane with the anode surface does not cause any detrimental effects. Alternatively, the contact of the membrane with the pure copper anode surface provides several advantages that were not previously obtainable with copper phosphate anodes. In particular, the membrane allows for greater flow control over the surface of the anode. Additionally, the membrane allows for isolation of the anode from the remainder of the plating solution, which prevents any contaminants generated at the anode surface from entering the plating solution and contaminating the plating process.

Figure 4:
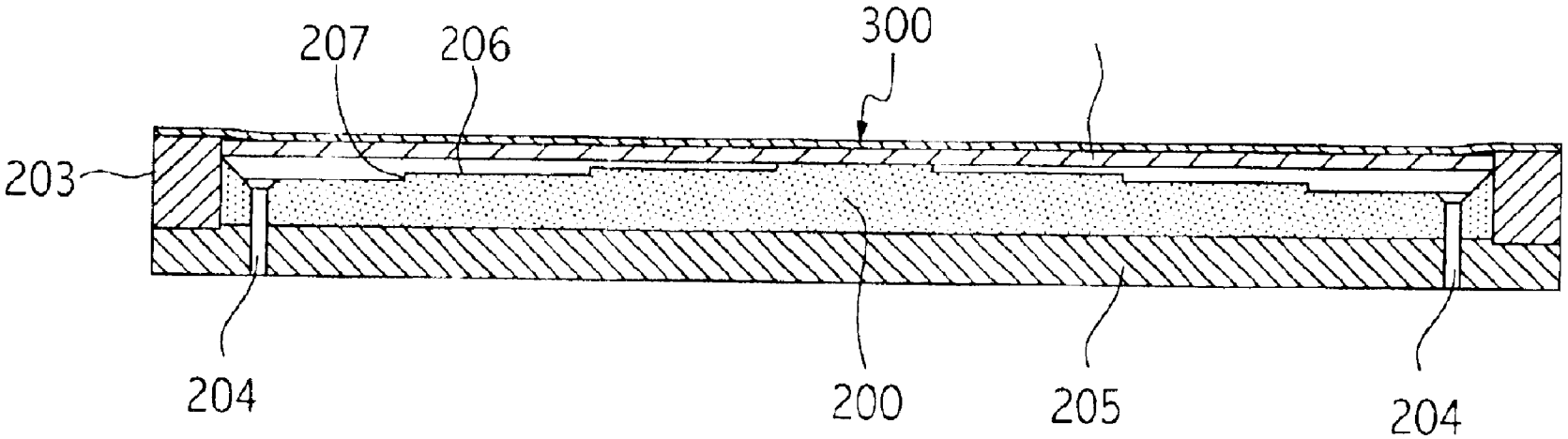
FIG. 4 illustrates an anode having a mesh layer positioned thereon.

FIG. 4 illustrates another embodiment of the invention, wherein a mesh layer 400 is positioned between the membrane 300 and the anode surface 200. Mesh layer 400 generally includes a relatively large grid size that may rest directly on the copper surface of the anode 200. The grid size is generally large enough to allow electrolyte flow therethrough, although the mesh itself will inherently restrict the electrolyte flow somewhat as a result of contact with the anode surface 200. IN one embodiment of the invention, the mesh layer may be a ¼ inch dielectric mesh layer that is placed over the surface of the anode 200 and fully covers the exposed upper surface of the anode 200. The mesh layer 400 generally operates to control the electrolyte flow over the surface of the anode 200, and in particular, mesh layer 400 may operate to anode erosion patterns, which increases the lifetime of the anode 200. Additionally, mesh layer 400 may operate to keep the vertical flow velocity through the membrane 300 positioned above mesh layer 400 independent of the copper thickness, which eliminates cavitation and defect issues. Mesh 400, for example, may be a Tyvek® layer, which is generally known in the art to be permeable/breathable. In another embodiment of the invention, mesh layer 400 may include a woven-type mesh layer. In this embodiment, the woven nature of the mesh layer 400 generally allows fluid to flow horizontally through the mesh layer 400. More particularly, when a woven-type of mesh layer is used, the exterior surface thereof is generally not planar, as the woven nature of the mesh layer 400 inherently results in a layer having a plurality of bumps or protrusions corresponding to the locations where a fiber of the weave wraps around another fiber extending a transverse direction. Similarly, in the areas between the bumps or protrusions, there are recessed areas in the mesh layer 400. These recessed areas allow for fluid flow, and therefore, when a woven-type mesh layer is implemented, fluid is allowed to flow across the surface of the anode even though the mesh layer 400 is in contact with the anode 200. Regardless of the configuration of the mesh layer 400, the mesh layer 400 generally operates to space the membrane 300 slightly away from the surface of the anode 200, which allows for improved fluid flow through the membrane 300.

Figure 5:
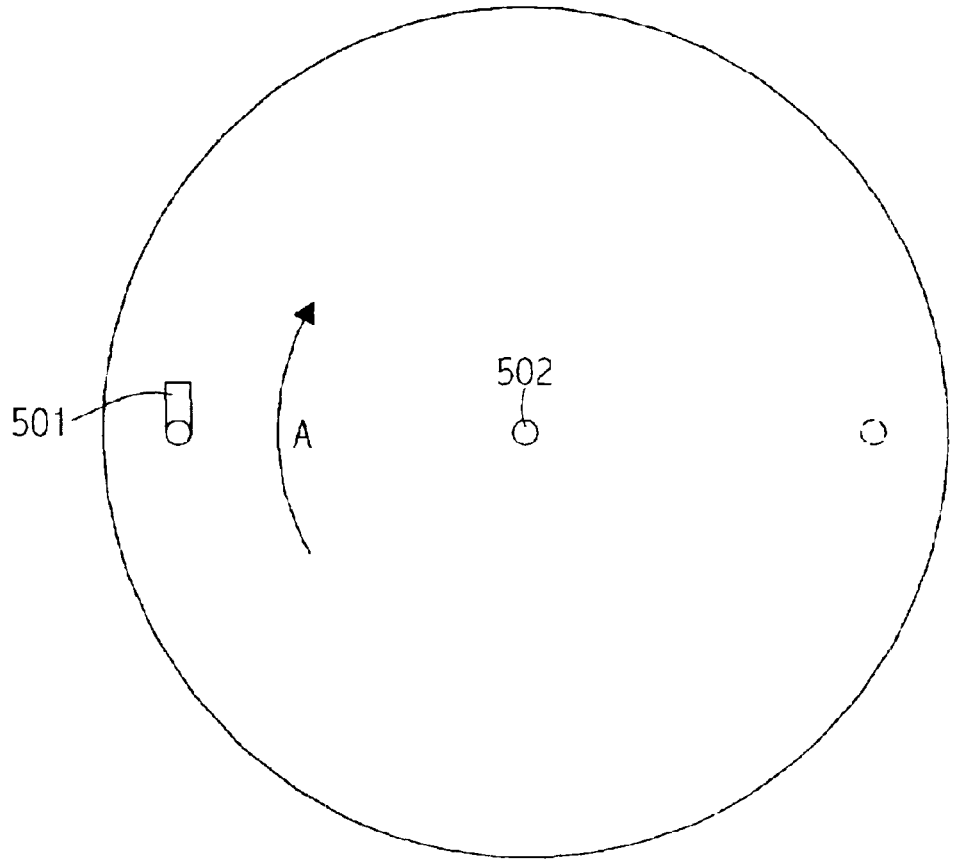
FIG. 5 illustrates an anode configured to provide a spiral electrolyte flow over the surface of the anode.
Figure 5:
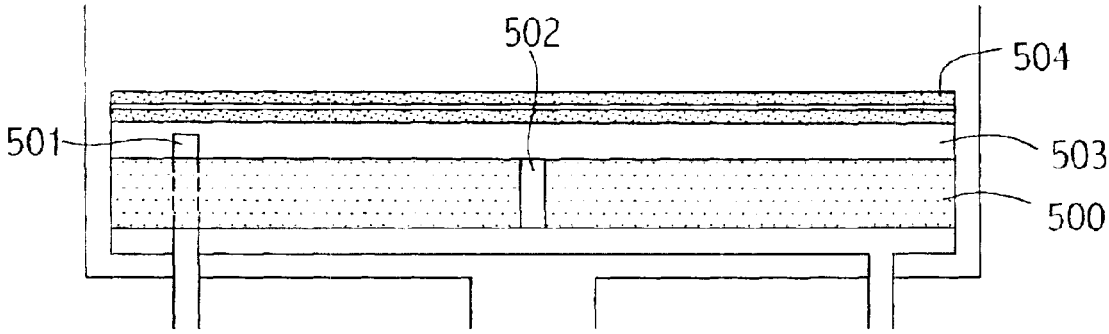

FIG. 5 illustrates a top and sectional view of an embodiment of an anode configured to provide a spiral flow of electrolyte over the surface of the anode. Anode 500, which is generally similar in structure to the anodes described in previous embodiments, includes at least one fluid inlet 501 positioned approximate the outer perimeter of anode 500. Additionally, anode 500 includes a fluid drain 502, which is generally positioned in a central portion of anode 500. Both the fluid inlet 501 in the fluid drain 500 may be in fluid communication with channels formed through the interior portion of anode 500, whereby the respective channels are in fluid communication with either a fluid supply or a fluid drain source (not shown). The fluid inlet 501 is generally configured to supply fluid to the anode surface, however, the fluid inlet is specifically designed to supply fluid to the anode surface such that a spiral flow across the surface of the anode is generated. More particularly, the aperture at the surface of anode 500 for fluid inlet 501 is configured to direct fluid flowing therefrom in a direction that is generally parallel to the perimeter of anode 500. As such, the fluid flowing from fluid inlet 501 is generally azimuthal, i.e., in the direction indicated by arrow "A". The spiraling fluid flow provides the advantage of ensuring full coverage of the anode with fresh or relatively fresh electrolyte throughout the plating process. Thus, the spiraling electrolyte flow operates in such a way to use pressure drops in angular momentum to insure relatively uniform flow over the entire top surface of the anode, while generally using only a single entry and exit location for the electrolyte being circulated over the surface of the anode.

Additionally, although FIG. 5 illustrates only a single fluid inlet 501, embodiments of the invention may include a plurality of fluid inlets radially positioned about the perimeter of anode 500. For example, embodiments of the invention contemplate that two or three fluid inlets may be equally positioned about the perimeter of anode 500 to encourage a spiral flow of electrolyte across the surface of the anode. In another embodiment of the invention, a plurality of fluid inlets 501 may be implemented, and further, the plurality of fluid inlets may be spaced at varying radius is from the central drain aperture 502. For example, a first fluid inlet 501 may be located at a first position proximate the perimeter of anode 500, a second fluid inlet 501 may be positioned at a second location on the perimeter of anode 500 (the second position being the same or different from the first position), and a third fluid inlet 501 may be positioned at a third location on the perimeter. However, the distance from the central drain aperture 502 may be different to each of the first, second, and third locations, i.e., the respective fluid inlet 501 may be positioned at varying distances from the central drain 502. As such, the outermost fluid inlet 501 may urge a spiral flow proximate the perimeter of anode 500, while the second fluid inlet 501 positioned, for example, about halfway between the perimeter of anode 500 and the central drain aperture 502, may urge a spiral flow across the surface of the anode near the middle portion of anode 500. Further, the third fluid inlet 501, which may be positioned closest to the central drain aperture 502, may be used to facilitate spiral fluid flow proximate the center of anode 500, i.e., near the central drain 502.

In another embodiment of the invention, anode 500 may further include a membrane 504 positioned immediately above the anode surface. Membrane 504, and similar fashion to the membrane layers described with respect to other aspects of the invention, may be configured to be permeable to the electrolyte solution, and further, to copper ions. However, inasmuch as electrolyte is being supplied to the area between the membrane 504, the direction of fluid flow through membrane 504 may be away from anode 500. As such, the membrane 504 may be configured to be non permeable to contaminants generated at the anode surface, which would prevent these contaminants sized larger than the pore size of the membrane 504 from leaving the area proximate the anode surface and contaminating plating solution that will come in contact with the substrate during plating operations. However, in this embodiment, membrane 504 would still be permeable to copper ions, so that the copper dissolved from anode 500 may be transmitted to the plating solution above the membrane 504. Additionally, inasmuch as membrane 504 may disturb the spiral fluid flow generated the anode surface by fluid inlets 501, a honeycomb structure 503 may be positioned between membrane 504 and anode 500. The honeycomb structure 503 may be configured to locally decrease flow velocities, so that entrained particles from anode slime do not plugged the aperture is a membrane 504. The aspect ratio of the honeycomb wall height to the wall spacing should be about 5:1 or greater, for example, so that the velocity of the fluid near the membrane is cut substantially, which insurers particles are not forced into the membrane. In another embodiment of the invention, a spiral shaped wall or partition may be placed immediately above anode 500. In this embodiment, the spiral shaped wall may operate to mechanically direct the electrolyte flow in a spiraling motion across the surface of anode 500. Additionally, the spiral shaped partition/wall may be formed into the lower surface of the honeycomb structure 503.

Figure 6:
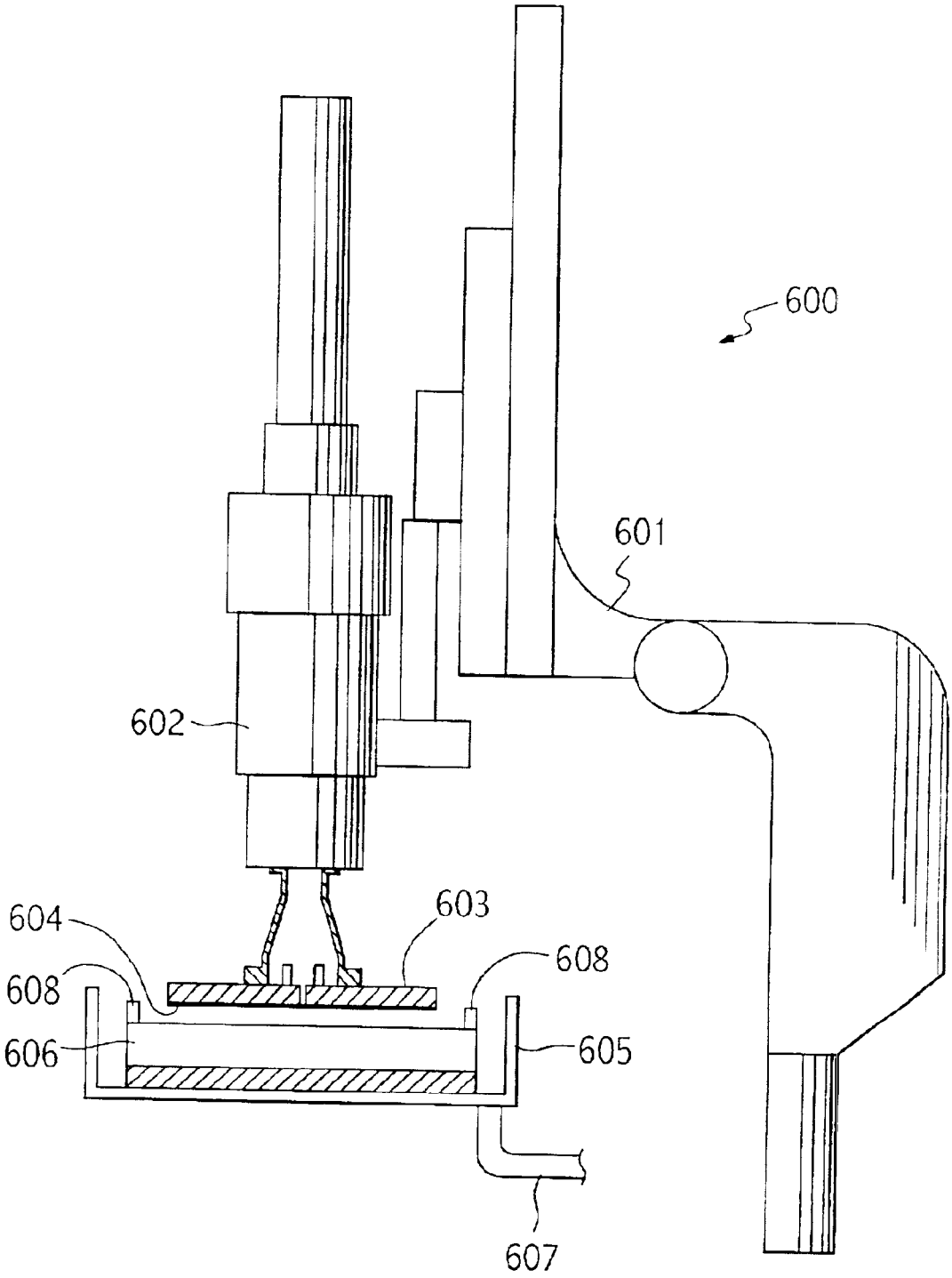
FIG. 6 illustrates a backside contact-type electrochemical plating apparatus configured to implement aspects of the invention.

FIG. 6 illustrates an exemplary backside contact-type electrochemical plating cell 600 that may be used to implement embodiments of the invention. Plating cell 600 generally includes a support arm assembly 601 configured to support a head assembly 602. Arm assembly 601 generally supports head assembly 602 at a position above a plating bath in a manner that allows the head assembly 602 to position a substrate in the plating bath for processing. The arm assembly 601 generally provides pivotal support for head assembly, and therefore, head assembly may be pivotally moved away from the plating bath positioned thereunder, which may allow for substrate loading and unloading from the substrate support member 603. The head assembly 602 is generally attached to a substrate, support member 603 at a lower portion thereof and is configured to provide vertical and rotational movement thereto, i.e., head assembly is generally configured to raise and lower the substrate support member into and out of the plating bath positioned below, as well as to rotate the substrate support member 603. The substrate support member 603 is generally configured to support a substrate on a lower surface thereof, i.e., wherein the lower surface is defined as the surface of the substrate support member positioned adjacent the plating bath. The substrate support member 603 receives a substrate and chucks or secures the substrate thereto via, for example, a vacuum chucking process. Additionally, the substrate support member 603 generally electrically contacts the substrate chucked thereto with a plurality of contact pins 604 radially positioned about the perimeter of the substrate support member 603. In this configuration, the substrate being plated is generally contacted on the backside or non-production side of the substrate. However, embodiments of the invention are not limited to backside contact configurations, as the substrate support member 300 illustrated in FIG. 6 may be equipped with a contact ring configured to electrically engage the production side of the substrate in the exclusion zone. Regardless of the contact configuration used, the substrate support member 300 is generally configured to support and electrically contact the substrate, and therefore, the necessary utilities, i.e., electrical power and chucking force, are provided to the substrate support member 603, generally by head assembly 602.

The plating bath of the plating cell 600 is generally contained in a lower portion of the cell 600. The lower portion generally includes an outer basin 605 having a fluid drain 607 positioned in a lower portion thereof. An inner basin 608 is generally positioned within the outer basin 605 and includes an upper wall portion configured to maintain a plating bath therein. An anode assembly 606 (which may be one of the anode embodiments discussed above) is generally positioned within the inner basin 608. As such, electrolyte is supplied to the inner basin 608 by a fluid supply source (not shown), and the anode 606 operates to supply metal ions to the electrolyte solution during plating operations.

During plating operations, for example, a substrate 148 is secured to the substrate supporting surface 146 of the lid 144 by a plurality of vacuum passages 160 formed in the surface 146, wherein passages 160 are generally connected at one end to a vacuum pump (not shown). The cathode contact ring 152, which is shown disposed between the lid 144 and the container body 142, is connected to a power supply 149 to provide power to the substrate 148. The contact ring 152 generally has a perimeter flange 162 partially disposed through the lid 144, a sloping shoulder 164 conforming to the weir 143, and an inner substrate seating surface 168, which defines the diameter of the deposition surface 154. The shoulder 164 is provided so that the inner substrate seating surface 168 is located below the flange 162. This geometry allows the deposition surface 154 to come into contact with the electroplating solution before the solution flows into the egress gap 158, as discussed above.

While the substrate 148 is positioned in the plating cell, a plating solution is pumped into the container body 142 via fluid inlet 150 by pump 151. The solution flows upward towards the substrate 148 by flowing around the perimeter portion 202 of anode 200 and upward towards the substrate 148. However, inasmuch as fluid drains 204 operate to receive electrolyte solution therein, a portion of the electrolyte solution travels through membrane 300 positioned above anode 200 and into fluid drains 204. This portion of the electrolyte solution, which is flowing across the surface of anode 200, generally operates to wash or urge particles residing on the surface of anode 200 towards the fluid drains 204. More particularly, the surface of anode 200 may be equipped with one or more channels 206 leading to fluid drains 204. In this embodiment, channels 206 provide a downhill path from the central portion 201 of the anode surface 200 to the perimeter portion 202 thereof. As such, particles, such as copper balls, for example, may be urged into channels 206 by the electrolyte flowing across the surface of anode 200. Thereafter, channels 206 allow the copper balls to flow downhill with the electrolyte flow towards the fluid drains 204, and therefore, the copper balls may be removed from the surface of anode 200.

If a spiral flow type anode is implemented, i.e., similar to the anode illustrated in FIG. 5, the electrolyte flow across the surface of the substrate will be somewhat different than the embodiment illustrated in FIG. 2. More particularly, inasmuch as the electrolyte solution will be provided to the anode surface via one or more fluid apertures 501, and recovered from the anode surface by the central drain 502, then the flow of the electrolyte solution across the surface of the anode will be in a spiraling motion. In similar fashion to previous embodiments, the spiraling motion of the electrolyte solution across the surface of the anode will operate to wash or urge particles residing on the anode surface towards the central drain 502. In particular, any copper balls residing on the anode surface may be urged by the spiraling motion into central drain 502, and therefore, be removed from the anode surface. Additionally, the spiraling electrolyte flow provides for uniform density of the electrolyte solution across the surface of the anode, i.e., the entire surface of the anode generally receives fresh electrolyte. If the honeycomb end or a spiral wall-type configuration is implemented, then the wall/partition positioned immediately above the anode surface will operate to mechanically direct electrolyte solution flowing over the surface of the anode in a spiraling motion.

While the foregoing is directed to embodiments of the present invention, other and further embodiments of the invention may be devised without departing from the basic scope thereof, and the scope thereof is determined by the claims that follow.

What is claimed is:

1. An electrochemical plating cell, comprising:

an electrolyte container assembly configured to hold a plating solution therein;

a head assembly positioned above the electrolyte container, the head assembly being configured to support a substrate during an electrochemical plating process; and an anode assembly positioned in a lower portion of the electrolyte container, the anode assembly comprising:

a copper member having an upper exposed surface;

at least one groove formed into the upper exposed surface, each of the at least one grooves originating in a central portion of the upper exposed surface and terminating at a position proximate a perimeter of the upper exposed surface; and at least one fluid outlet positioned at a perimeter of the upper exposed surface.

2. The electrochemical plating cell of claim 1, wherein the copper member comprises a disk shaped member manufactured from at least one of soluble pure copper and soluble copper phosphate.

3. The electrochemical plating cell of claim 1, wherein the at least one groove comprises between about 2 and about 4 grooves.

4. The electrochemical plating cell of claim 1, wherein each of the at least one grooves comprises at least one of a v-shaped channel, a semi-circular channel, and a square shaped channel.

5. The electrochemical plating cell of claim 1, wherein each of the at least one grooves originates at a predetermined distance from a center of the copper member and extends radially outward therefrom.

6. The electrochemical plating cell of claim 5, wherein each of the at least one grooves is equally spaced around a circumference of the perimeter.

7. The electrochemical plating cell of claim 1, wherein each of the at least one grooves comprises a channel extending radially outward toward the perimeter of the anode, each of the at least one channels forming a downhill fluid path therein.

8. The electrochemical plating cell of claim 7, wherein each of the at least one grooves includes at least one step-down portion, each of the at least one step down portions operating to deepen the at least one groove.

9. The electrochemical plating cell of claim 1, wherein the at least one fluid outlet comprises a titanium conduit extending through an interior portion of the anode, the titanium conduit being in fluid communication with the substantially planar upper surface and configured to receive fluids therefrom.

10. The electrochemical plating cell of claim 1, wherein the at least one fluid outlet comprises between about 2 fluid outlets and about 4 fluid outlets.

11. The electrochemical plating cell of claim 1, further comprising a permeable membrane positioned immediately above the anode upper surface.

12. The electrochemical plating cell of claim 11, wherein the membrane includes pores having a diameter of between about 0.05 microns and about 0.5 microns.

13. The electrochemical plating cell of claim 11, wherein the membrane includes pores having a diameter of between about 0.15 microns and about 0.25 microns.

14. The electrochemical plating cell of claim 11, wherein the membrane is in contact with the upper surface of the anode.

15. The electrochemical plating cell of claim 11 further comprising a mesh layer positioned between the membrane and the anode surface.

16. An anode for an electrochemical plating cell, comprising a disk shaped soluble anode having an upper anode surface formed thereon, the upper anode surface having at least one channel and at least one fluid outlet formed therein, each of the at least one channels originating at a central portion of the upper anode surface and terminating proximate one of the at least one fluid outlets.

17. The anode of claim 16, wherein the soluble anode comprises at least one of pure copper and copper phosphate.

18. The anode of claim 16, wherein the at least one channel comprises at least one of a v-shaped, a semi-circular shaped, and a square shaped channel in cross section.

19. The anode of claim 16, wherein the at least one channel comprises a step-wise-type channel configured to flow liquid outward from the central portion of the anode.

20. The anode of claim 16, wherein each of the at least one channels forms a downhill fluid path between the central portion of the anode and a corresponding one of the at least one fluid outlets positioned proximate the perimeter of the anode.

21. The anode of claim 16, further comprising a membrane positioned immediately above the upper surface of the anode.

22. The anode of claim 21, wherein the membrane is positioned in contact with the upper surface of the anode.

23. The anode of claim 21, wherein the membrane includes pores having a diameter of between about 0.1 microns and about 0.3 microns.

24. The anode of claim 21, wherein the membrane includes pores having a diameter of between about 0.15 microns and about 0.25 microns.

25. The anode of claim 16, further comprising a mesh layer positioned between the membrane and the upper surface of the anode.

26. A copper anode for an electrochemical plating cell, comprising:

a substantially circular base member;

a circular sleeve member positioned above and in sealable contact with a perimeter of the base member;

a circular disk shaped pure copper anode positioned within the sleeve member and in contact with the base member, the anode having an exposed upper anode surface;

at least one fluid drain positioned proximate a perimeter of the anode, the at least one fluid drain being configured to communicate fluids through an interior portion of the anode; and at least one fluid channel formed into the upper anode surface, each of the at least one fluid channels originating proximate a central portion of the upper anode surface and terminating proximate the at least one fluid drain, the at least one fluid channel forming a downhill fluid path from the central portion to the at least one fluid drain.

27. The copper anode of claim 26, wherein the base member and the sleeve member are manufactured from an insulative material.

28. The copper anode of claim 26, wherein the at least one fluid channel has at least one of a v-shaped, a semi-circular, and a square cross section.

29. The copper anode of claim 26, wherein the at least one fluid channel comprises at least two planar sections having a step-down section interstitially positioned.

30. The copper anode of claim 26, wherein the at least one fluid drain comprises a bore formed through the anode, the bore having a titanium sleeve positioned therein to communicate fluids therethrough.

31. The copper anode of claim 26, wherein the at least one fluid channel comprises between about 2 and about 4 fluid channels extending radially outward from the central portion.

32. The copper anode of claim 26, further comprising a permeable membrane positioned immediately above the exposed upper anode surface.

33. The copper anode of claim 32, wherein the membrane includes pores having a diameter of between about 0.05 microns and about 0.5 microns.

34. The copper anode of claim 32, wherein the membrane includes pores having a diameter of between about 0.15 microns and about 0.25 microns.

35. The copper anode of claim 32, wherein the membrane is in contact with the substantially planar upper anode surface.

36. The copper anode of claim 32, further comprising a mesh layer positioned between the membrane and the upper anode surface.

* * * * *

UNITED STATES PATENT AND TRADEMARK OFFICE

CERTIFICATE OF CORRECTION

PATENT NO. : 6,855,235 B2
DATED : February 15, 2005
INVENTOR(S) : Herchen et al.

It is certified that error appears in the above-identified patent and that said Letters Patent is hereby corrected as shown below:

Title page,
Item [75], Inventors, change "Quinwei" to -- Qunwei --.

Signed and Sealed this

Eighteenth Day of April, 2006

JON W. DUDAS
*Director of the United States Patent and Trademark Office*